US005377766A

United States Patent [19]

Klinger

[11] Patent Number: 5,377,766

[45] Date of Patent: Jan. 3, 1995

[54] APPARATUS FOR CLEANING EXCESS ROADSTONE AWAY FROM A GUTTER

[75] Inventor: Wayne M. Klinger, Winnebago, Ill.

[73] Assignee: Northern Illinois Service Co., Rockford, Ill.

[21] Appl. No.: 45,114

[22] Filed: Apr. 12, 1993

[51] Int. Cl.[6] ..... E02F 3/76

[52] U.S. Cl. ..... 172/782; 172/786; 172/382; 172/817; 37/407

[58] Field of Search ..... 172/810, 777, 778, 782, 172/784, 786, 17, 18, 201, 815, 827, 382, 817, 701.2; 37/407, 903, 271-272, 448, 364; 404/104, 75, 7

[56] References Cited

U.S. PATENT DOCUMENTS

| | | | |
|---|---|---|---|
| 1,843,260 | 2/1932 | Arnold et al. | 172/782 |
| 1,869,916 | 8/1932 | Schmid | 172/782 |
| 2,240,108 | 4/1941 | Wiese | 172/382 |
| 3,011,562 | 12/1961 | Brasch | 172/17 |
| 4,936,392 | 6/1990 | Kitchin | 172/815 |

*Primary Examiner*—Randolph A. Reese
*Assistant Examiner*—Spencer Warnick
*Attorney, Agent, or Firm*—Leydig, Voit & Mayer

[57] ABSTRACT

An angled blade unit is attached to a loader bucket and, as the bucket is moved along a roadway, the blade unit plows excess roadstone away from a newly poured concrete gutter in order to prepare a roadbed for paving. A gage rides along the flag of the gutter and limits the depth to which the blade unit plows into the roadstone.

7 Claims, 2 Drawing Sheets

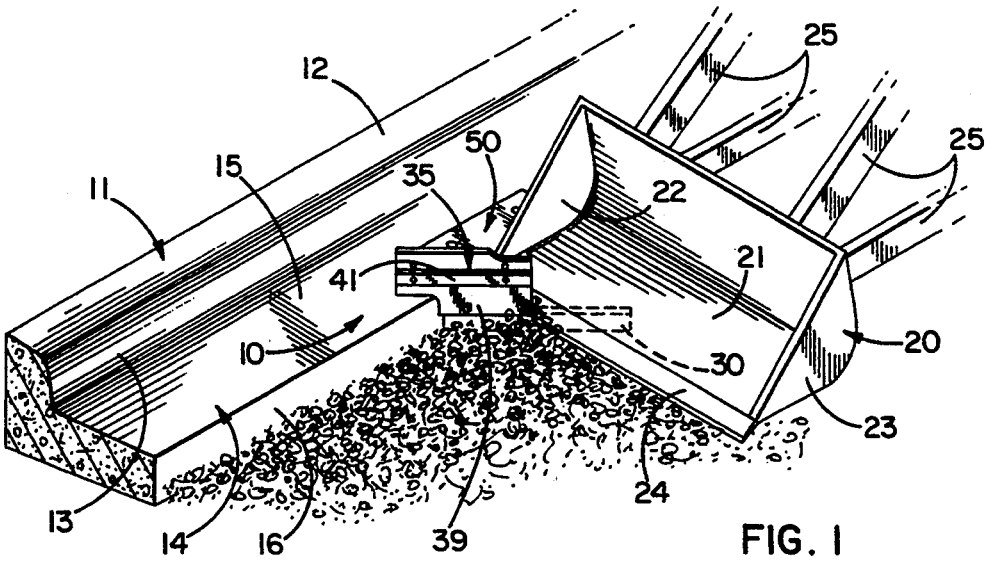
FIG. 1
FIG. 2
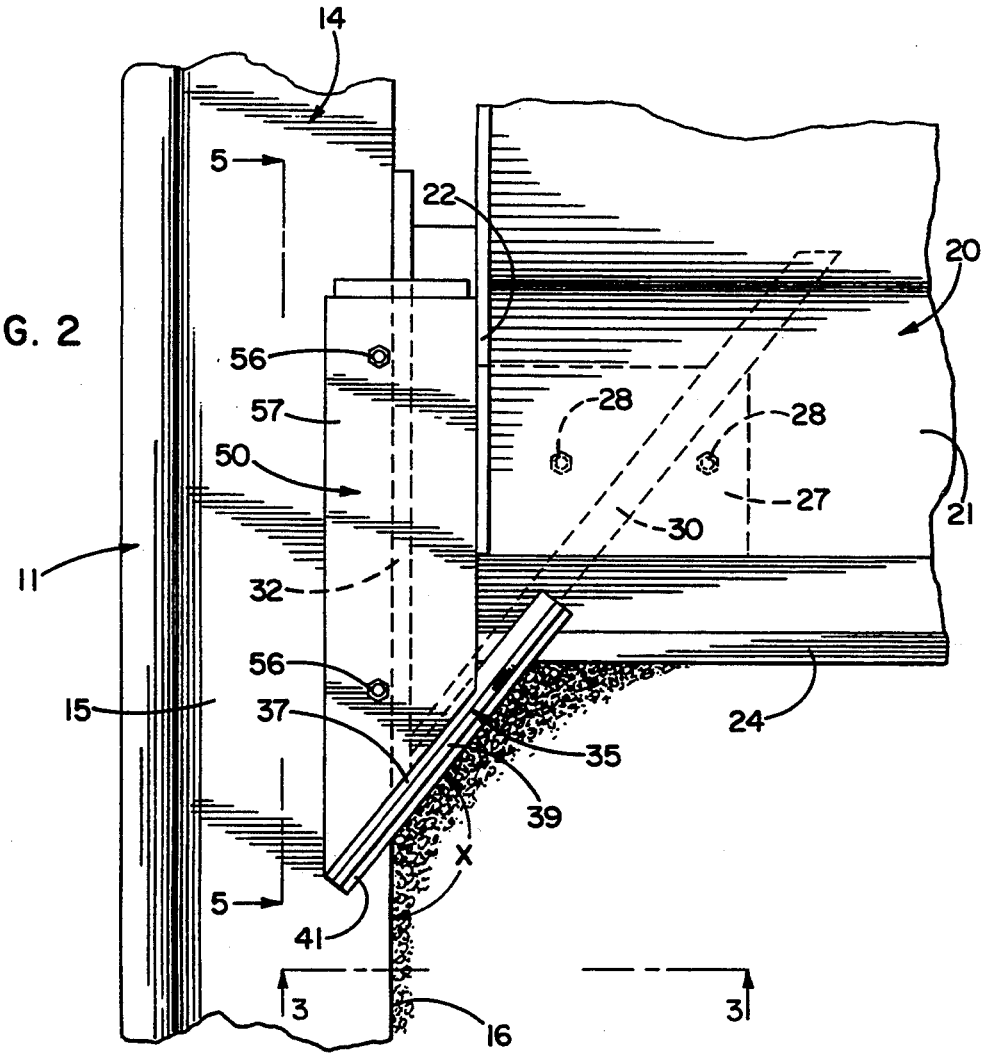

APPARATUS FOR CLEANING EXCESS ROADSTONE AWAY FROM A GUTTER

BACKGROUND OF THE INVENTION

This invention relates to apparatus which is especially useful for removing excess roadstone adjacent the gutter of a concrete combination curb and gutter in order to establish a level roadbed preparatory to paving the roadbed.

In building a roadway such as a residential street, a concrete combination curb and gutter is poured along each side of the roadway. The gutter includes a generally horizontal flag extending outwardly from the face of the curb and further includes an upright outer face extending downwardly from the outer edge of the flag.

After the combination curbs and gutters have been poured, roadstone is spread on the roadway and is graded to a level condition to establish a roadbed which is spaced a predetermined distance (e.g., 2–4") below the flag of the gutter. When the roadway is subsequently paved with asphalt or the like, the upper surface of the pavement is substantially flush with the flag.

During the course of grading the roadway, roadstone is pushed against and piles up adjacent the face of the gutter. In order for the pavement to be flush with the flag, it is necessary to remove the excess roadstone from adjacent the gutter face and to bring that area of the roadway back to the same level as the remainder of the roadway. In the past, the excess roadstone has been removed manually by sweeping or shoveling the roadstone away from the face. This is laborious, time-consuming and costly.

SUMMARY OF THE INVENTION

The general aim of the present invention is to provide new and improved apparatus with which excess roadstone may be quickly and easily removed from the region of a gutter face with the expenditure of only very little time and effort.

A more detailed object of the invention is to achieve the foregoing by providing apparatus having a blade unit adapted to be attached to a self-propelled implement and adapted to plow the excess roadstone away from the gutter face as the implement travels along the roadway.

Still another object of the invention is to provide apparatus in which a gage is associated with the blade unit and rides along the flag of the gutter to limit the depth to which the blade unit plows into the roadstone and thereby cause the roadbed to be established a predetermined distance below the flag.

The invention also resides in the provision of means for adjusting the apparatus in order to establish roadbeds located various predetermined distances below the flag.

A further object is to provide means for guiding the blade unit in a straight path closely adjacent to and parallel with the face of the gutter.

These and other objects and advantages of the invention will become more apparent from the following detailed description when taken in conjunction with the accompanying drawings.

BRIEF DESCRIPTION OF THE DRAWINGS

FIG. 1 is a perspective view showing the new and improved apparatus of the present invention plowing excess roadstone away from a typical gutter.

FIG. 2 is an enlarged fragmentary top plan view of the apparatus shown in FIG. 1.

DETAILED DESCRIPTION OF THE PREFERRED EMBODIMENTS

Figure 3:
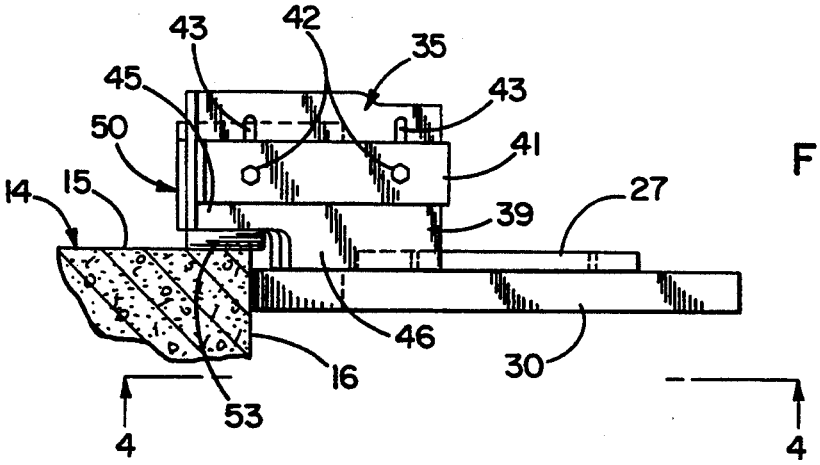
FIG. 3 is a front end view of the apparatus as seen substantially along the line 3—3 of FIG. 2.

For purposes of illustration, the invention has been shown in the drawings as incorporated in apparatus 10 which is especially useful in preparing a roadway for paving with asphalt, concrete or the like. In the roadway which has been illustrated, a concrete combination curb and gutter has been shown as extending along one side of the roadway. The curb 11 includes a top 12 and an outer face 13 while the gutter 14 includes a flag 15 and an outer face 16. The flag 15 of the gutter extends outwardly from the face 13 of the curb and is generally horizontal. The face 16 of the gutter is generally vertical and extends downwardly from the outer edge of the flag 15.

After pouring of the curb 11 and gutter 14, roadstone is spread onto the roadway and is graded into a level condition. The roadstone is located a predetermined distance (e.g., 2") below the flag 15 of the gutter so that, when a layer of paving material of the same thickness is applied to the roadway, the ultimate pavement is substantially flush with the flag.

During grading of the roadway, roadstone is pushed against and builds up alongside the face 16 of the gutter 14. In order to insure a flush relationship between the eventual pavement and the flag 15, it is necessary to remove the excess roadstone from the vicinity of the face 16 so that the area of the roadway adjacent the face will be at substantially the same elevation as the rest of the roadway.

The present invention contemplates the provision of relatively simple and trouble-free apparatus 10 which plows the excess roadstone away from the face 16 of the gutter 14 with the expenditure of very little time and effort. As will become apparent, the apparatus of the invention eliminates the need of manually sweeping or shoveling the excess roadstone away from the face.

More specifically, the plowing apparatus 10 of the invention is an attachment which may be secured detachably to an implement 20 adapted to be moved along the roadway by a self-propelled vehicle such as a skid-steer loader. In this particular instance, the implement 20 has been shown as being a loader bucket having a bottom wall 21, two laterally spaced end walls 22 and 23, and a front scooping lip 24 extending between the end walls at the forward edge of the bottom wall. Arms 25 connect the bucket to the vehicle and may be swung upwardly and downwardly to raise and lower the bucket.

Herein, the plowing attachment 10 includes a generally rectangular mounting plate 27 adapted to be detachably secured to the lower side of the bottom wall 21 of the bucket 20 by bolts 28. Welded to the underside of the mounting plate is an elongated rake bar 30 of square cross-section. The bar is angled relative to the bucket and its front end portion projects forwardly of the lip 24 and outboard of the end wall 22. At its forward end, the bar is welded to a hardened wear plate 32 (FIGS. 2, 4 and 5) disposed in a vertical plane and extending rearwardly from the bar in parallel relation to the end wall 22 and the face 16 of the gutter 14. The bar 30 and the plate 32 thus define a generally V-shaped structure having lower surfaces disposed in a common plane.

A blade unit 35 is attached to the forward end of the bar 30 and extends along the same angle as the bar. In this instance, the blade unit comprises a moldboard 37 welded to and projecting upwardly from the bar 30. A scraper blade 39 is disposed in face-to-face relation with the moldboard and is clamped thereto by a strap 41 (FIG. 3) and a pair of bolts 42, the latter extending through vertically elongated slots 43 in the scraper blade. Both the moldboard and the scraper blade include portions which overhang the flag 15 of the gutter 14 and include depending portions extending downwardly from the flag. The overhanging and depending portions of the blade 39 have been designated as 45 and 46, respectively, in FIG. 3.

As shown most clearly in FIG. 2, the blade unit 35 extends at an obtuse angle x of about 140 degrees relative to the face 16 of the gutter 14. Thus, as the blade unit and the bar 30 are moved forwardly, excess roadstone is plowed away from the face 16 of the gutter 14 and is raked toward the center of the roadway. The long bar 30 tends to spread and level the roadstone emerging from the rear of the blade unit so as to avoid leaving a windrow of material.

Figure 4:
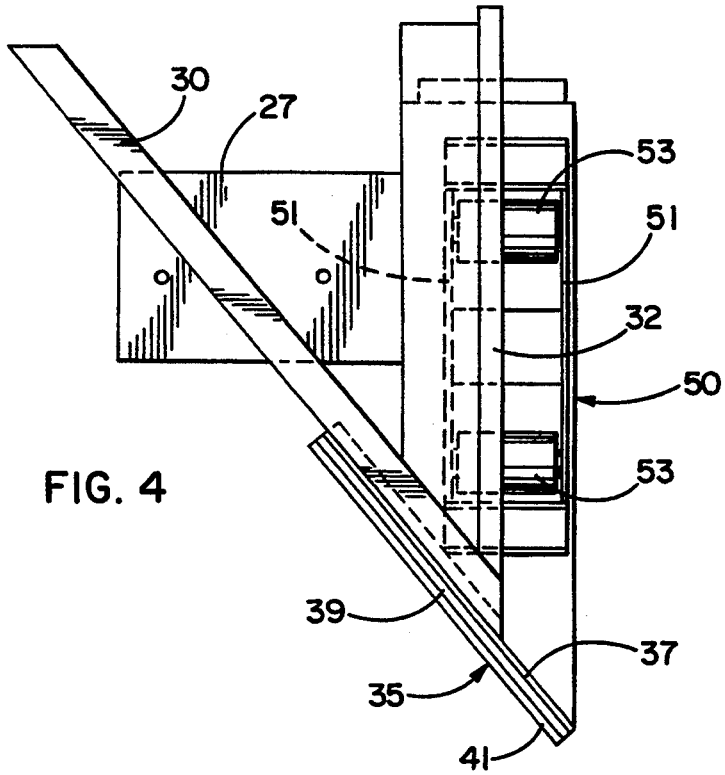
FIG. 4 is a bottom plan view of the apparatus as seen substantially along the line 4—4 of FIG. 3.
Figure 5:
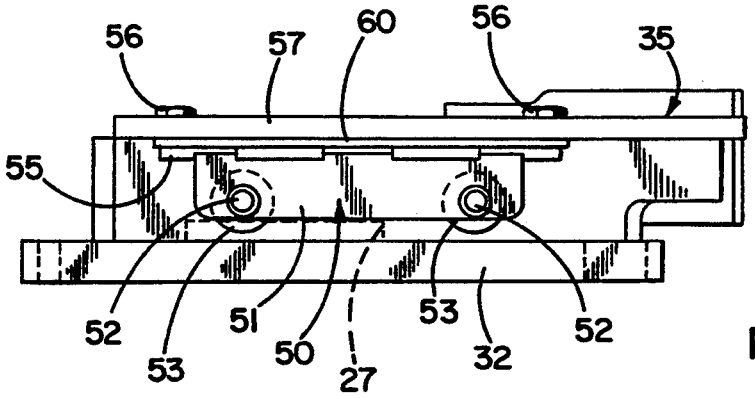
FIG. 5 is a side elevational view of the apparatus as seen substantially along the line 5—5 of FIG. 2.

Advantageously, the rake bar 30 and the blade unit 35 are held at a predetermined elevation and are prevented from plowing too deeply into the roadstone. For this purpose, the apparatus 10 includes a gage 50 which rides along the flag 15 of the gutter 14 to limit the penetration of the bar and the blade unit. Herein, the gage 50 is in the form of a truck having a pair of laterally spaced frame plates 51 spanned by front and rear horizontal axles 52 which rotatably support front and rear rollers 53 (FIGS. 3–5). The truck 50 includes a top plate 55 spanning the frame plates 51 and secured by bolts 56 to a main top plate 57 which is welded to the bar 30 and the wear plate 32. A shim plate 60 (FIG. 5) is sandwiched between the top plates 55 and 57 and its thickness establishes the vertical position of the rollers 53 relative to the bar 30 and the blade unit 35.

With the foregoing arrangement, the rollers 53 of the gage or truck 50 ride along the flag 15 of the gutter 14 and hold the rake bar 30 and the blade unit 35 at a predetermined elevation so as to prevent those components from digging too deeply into the roadstone. At the same time, the forward end of the rake bar 30 is kept closely adjacent the face 16 of the gutter 14 by virtue of the hardened wear plate 32 engaging the face and thereby serving to guide the bar. In other words, the operator steers the vehicle so as to keep the wear plate 32 in engagement with the face 16 and thus insure that the bar and the blade unit plow away roadstone immediately adjacent the face.

By replacing the shim plate 60 with a plate of greater or lesser thickness, the depth of penetration of the bar 30 and blade unit 35 may be reduced or increased, respectively. For example, by using shim plates of different thicknesses, the lower side of the bar may be spaced either 2", 2-½", 3", or 3-½" below the flag 15. Adjustment of the blade 39 relative to the bar 30 may be achieved by means of the bolts 42 and the slots 43.

From the foregoing, it will be apparent that the present invention brings to the art new and improved apparatus 10 for plowing excess roadstone away from a gutter 14 in order to enable paving material to be laid flush with the flag 15 of the gutter. Thus, the need for manually sweeping, raking or shoveling the excess roadstone is avoided.

It will be appreciated that the apparatus 10 or similar apparatus could be used in preparing a roadway adjacent concrete structures such as a sidewalk. In such an instance, the truck 50 rides along the top horizontal surface of the sidewalk while the bar 30 and the blade unit 35 plow roadstone away from the vertical face or wall of the sidewalk.

I claim:

1. Apparatus for plowing excess roadstone away from an upright outer face of a longitudinally extending concrete gutter having a generally horizontal flag at the upper end of the face in order to establish a substantially level roadbed adjacent the face and a predetermined distance below the flag, said apparatus comprising an implement adapted to be propelled longitudinally along the roadbed in the direction of the gutter, said implement having a pair of spaced end walls and having a front scooping lip extending between said end walls, a blade attached to said implement and projecting forwardly from said lip adjacent one of said end walls and being angled so as to extend outboard of said one end wall, said blade being angled with respect to the direction of travel of said implement and being angled at an obtuse angle relative to said face, said blade having a forward end portion located adjacent said face whereby said blade plows roadstone away from said face upon being propelled forwardly, and a gage associated with said blade and riding along said flag to limit the depth to which said blade plows into said roadstone.

2. Apparatus as defined in claim 1 in which said implement comprises a loader bucket.

3. Apparatus as defined in claim 2 in which said bucket includes a bottom having a lower side, and means detachably securing said blade and said gage to the lower side of the bottom of said bucket.

4. Apparatus as defined in claim 1 in which said gage comprises a truck attached to said blade and having at least one roller adapted to ride along said flag.

5. Apparatus as defined in claim 4 further including means for enabling the vertical spacing between said roller and said blade to be selectively adjusted.

6. Apparatus as defined in claim 1 further including means engageable with the face of said gutter to guide said blade for movement along a path extending generally parallel to said face.

7. Apparatus for plowing excess roadstone away from an upright outer face of a longitudinally extending concrete structure having a generally horizontal surface at the upper end of said face, said apparatus acting to establish a substantially level roadbed adjacent the face and a predetermined distance below the generally horizontal surface of the concrete structure, said apparatus comprising an implement adapted to be propelled longitudinally along the roadbed in the direction of the concrete structure, a blade attached to said implement and projecting forwardly therefrom, said blade being angled with respect to the direction of travel of said implement and being angled at an obtuse angle relative to said face, said blade having a forward end portion, means engageable with said face and guiding said implement to cause the forward end portion of said blade to be positioned adjacent said face and to plow roadstone away from the face as the implement is propelled forwardly, a gage truck attached to said blade and having at least one roller riding along the generally horizontal surface of said concrete structure to limit the depth to which said blade plows into said roadstone, and means for enabling the vertical spacing between said roller and said blade to be selectively adjusted.

* * * * *